US008382427B2

(12) United States Patent
Horng

(10) Patent No.: US 8,382,427 B2
(45) Date of Patent: Feb. 26, 2013

(54) BLOWER FAN

(75) Inventor: Alex Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 526 days.

(21) Appl. No.: 12/403,428

(22) Filed: Mar. 13, 2009

(65) Prior Publication Data

US 2010/0232957 A1 Sep. 16, 2010

(51) Int. Cl.
*F04D 29/54* (2006.01)

(52) U.S. Cl. ..... 415/206

(58) Field of Classification Search ..... 415/203–206, 415/102; 416/185, 186 R, 187, 188
See application file for complete search history.

(56) References Cited

U.S. PATENT DOCUMENTS 6,132,170 A * 10/2000 Horng ..... 415/178
6,568,905 B2 * 5/2003 Horng et al. ..... 415/206
7,244,099 B2 * 7/2007 Yamasaki ..... 415/173.6
7,470,107 B2 * 12/2008 Chen ..... 415/198.1
2003/0063973 A1 * 4/2003 Horng et al. ..... 415/204
2005/0152781 A1 * 7/2005 Baek et al. ..... 415/206
2005/0226721 A1 * 10/2005 Higashida ..... 415/206
2008/0226472 A1 9/2008 Kanai et al.
2008/0310957 A1 12/2008 Lyons
2009/0010757 A1 1/2009 Hwang et al.
2010/0232957 A1 * 9/2010 Horng ..... 415/208.1

* cited by examiner

*Primary Examiner* — Ross Gushi
(74) *Attorney, Agent, or Firm* — Alan Kamrath; Kamrath IP Lawfirm, PA

(57) ABSTRACT

A blower fan includes a housing having a compartment. A stator and an impeller are mounted in the compartment. The housing further includes an air inlet and an air outlet both communicated with the compartment. The impeller has a hub and a plurality of vanes coupled to the hub. Each vane includes an upper edge whose end is an air input portion adjacent to the air inlet of the housing, and an air gap is formed between the upper edge of each vane and a top of the housing, with various widths of the air gap ranging from 0.3 mm to 2.0 mm, while a shortest width of the air gap is formed between the air input portion of the upper edge and the top of the housing for providing reduced turbulence and noises.

11 Claims, 4 Drawing Sheets

BLOWER FAN

BACKGROUND OF THE INVENTION

1. Field of the Invention

The present invention relates to a blower fan and, more particularly, to a blower fan providing reduced turbulence and increased amount of input and output air.

2. Description of Related Art

FIG. 1 illustrates a conventional blower fan comprising a housing 7, a stator 8 and an impeller 9. The housing 7 has an axial tube 71 mounted on a bottom of the housing 7, and an air inlet 72 and an air outlet 73 formed in a top and a side wall of the hosing 7 respectively. The stator 8 is coupled to the outer periphery of the axial tube 71. The impeller 9 has a shaft 91 rotatably coupled to the axial tube 71 through a bearing. The impeller 9 further includes a hub 92 and a plurality of vanes 93. The hub 92 has an upper cover 921 for the shaft 91 to couple with a center of the upper cover 921, a side wall 922 connecting with an outer periphery of the upper cover 921 and encircling the shaft 91, and an enclosing plate 923 connecting with a free end of the side wall 922 and radially extending outwards. The vanes 93 are formed on a surface of the enclosing plate 923, close to a radially outer edge of the surface, and spaced at a regular interval. Therefore, when the conventional blower fan starts working, air is drawn into the housing 7 by the impeller 9 via the air inlet 72 and then exit the housing 7 via the air outlet 73.

It should be noted that an upper edge of each vane 93 and the enclosing plate 923 are respectively parallel to a top and a bottom of the housing 7, with an air gap W between the upper edge of each vane 93 and the top of the housing 7 for avoiding friction or collision. However, during a period of time wherein the conventional blower fan works and the air is drawn into the housing 7 through the air inlet 72, an air pressure in the housing 7 forces the air to flow reversely toward the air inlet 72 through the air gap W. Accordingly, the amount of input air of the conventional blower fan is decreased adversely. Meanwhile, the air flowing reversely interfere with the air flowing in to the housing 7 and turbulence is easily produced. Accordingly, the overall noises of the conventional blower fan are increased, and the amount of output air is reduced. Hence, a novel blower fan is required to solve the problem.

SUMMARY OF THE INVENTION

The primary objective of the present invention is to provide a blower fan for suppressing reverse air currents, for reducing turbulence and noises, and for increasing overall amount of input air.

The further objective of the present invention is to provide a blower fan having unobstructed flow paths for increasing overall amount of input and output air.

In accordance with an aspect of the present invention, a blower fan comprises a housing having a compartment and a bearing tube mounted in the compartment. A stator and an impeller are mounted in the compartment and coupled to the bearing tube of the housing. The housing further includes an air inlet and an air outlet both communicated with the inner compartment. The impeller has a hub and a plurality of vanes coupled to the hub. Each vane includes an upper edge whose end is an air input portion adjacent to the air inlet of the housing, and an air gap is formed between the upper edge of each vane and a top of the housing, with various widths of the air gap ranging from 0.3 mm to 2.0 mm, while a shortest width of the air gap is formed between the air input portion of the upper edge and the top of the housing. Accordingly, a flow path formed between the upper edges of the vanes and the top of the housing narrows toward the air input portion, air is not liable to flow reversely to the air inlet for, hence, avoiding turbulence formed at the air inlet adjacent to the air input portion, reducing the wind shear noises, and increasing the overall amount of input air.

Preferably, the impeller has an enclosing plate coupled to an end of the hub. The enclosing plate includes a lower surface whose end is a lateral edge distant from the hub, with an air gap being formed between the lower surface and the bottom of the housing, and various widths of the air gap ranging from 0.3 to 2.0 mm while the shortest width is formed between the lateral edge of the lower surface and the bottom of the housing for, thus, avoiding turbulence formed between the enclosing plate and the bottom of the housing, and reducing the wind shear noises.

Further scope of the applicability of the present invention will become apparent from the detailed description given hereinafter. However, it should be understood that the detailed description and specific examples, while indicating preferable embodiments of the invention, are given by way of illustration only, since various will become apparent to those skilled in the art from this detailed description.

Figure 1:
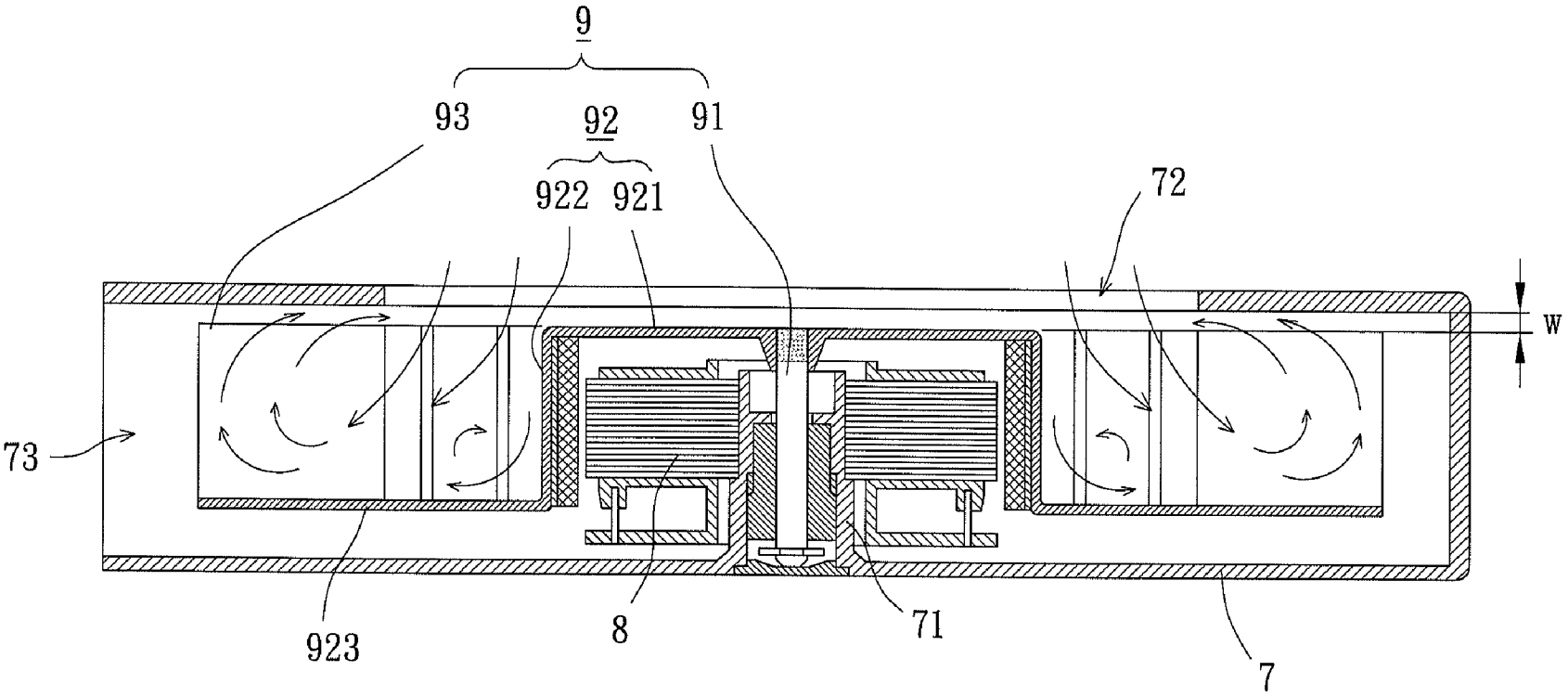
FIG. 1 PRIOR ART
FIG. 1 is a cross sectional view of a conventional blower fan, illustrating the routes of the air currents.

In the various figures of the drawings, the same numerals designate the same or similar parts. Furthermore, when the terms "first", "second", "upper", "lower", "top", "bottom", "width", "inner", "outer" and similar terms are used hereinafter, it should be understood that these terms are reference only to the structure shown in the drawings as it would appear to a person viewing the drawings and are utilized only to facilitate describing the invention.

DETAILED DESCRIPTION OF THE PREFERRED EMBODIMENTS

A blower fan according to the preferred teachings of the present invention is shown in FIGS. 2-7 of the drawings. In the first embodiment shown in FIG. 2, the blower fan generally includes a housing 1, a stator 2 and an impeller 3. The housing 1 has a compartment 10 receiving the stator 2 and the impeller 3, and a bearing tube 11 formed in the compartment 10 for the stator 2 to couple to an outer periphery of the bearing tube 11. Besides, a bearing 110 is formed in the bearing tube 11 for the impeller 3 to rotatably mount in. The housing 1 further includes a cover plate 12 formed on a top of the housing 1 and an air outlet 13 formed on a side wall of the housing 1. The cover plate 12 has a first air inlet 121, whose center is aligned with an axis of the bearing tube 11, with the first air inlet 121 and the air outlet 13 communicating with the compartment 10.

The impeller 3 includes a hub 31, a shaft 32, an enclosing plate 33 and a plurality of vanes 34. The hub 31 has an upper cover 311 and a side wall 312. The side wall 312 is connected with an outer periphery of the upper cover 311, for an inner space surrounded by the upper cover 311 and the side wall 312 to accommodate the stator 2. The shaft 32 protrudes from a center of the upper cover 311 for engaging with the bearing tube 11. The enclosing plate 33 is connected with a free end of the side wall 312 and radially extending outwards, which is preferably perpendicular to the side wall 312. Each vane 34 is mounted on a surface adjacent to an end of the enclosing plate 33, with an air-flowing interval being formed between the plurality of vanes 34 and the side wall 312.

Figure 2:
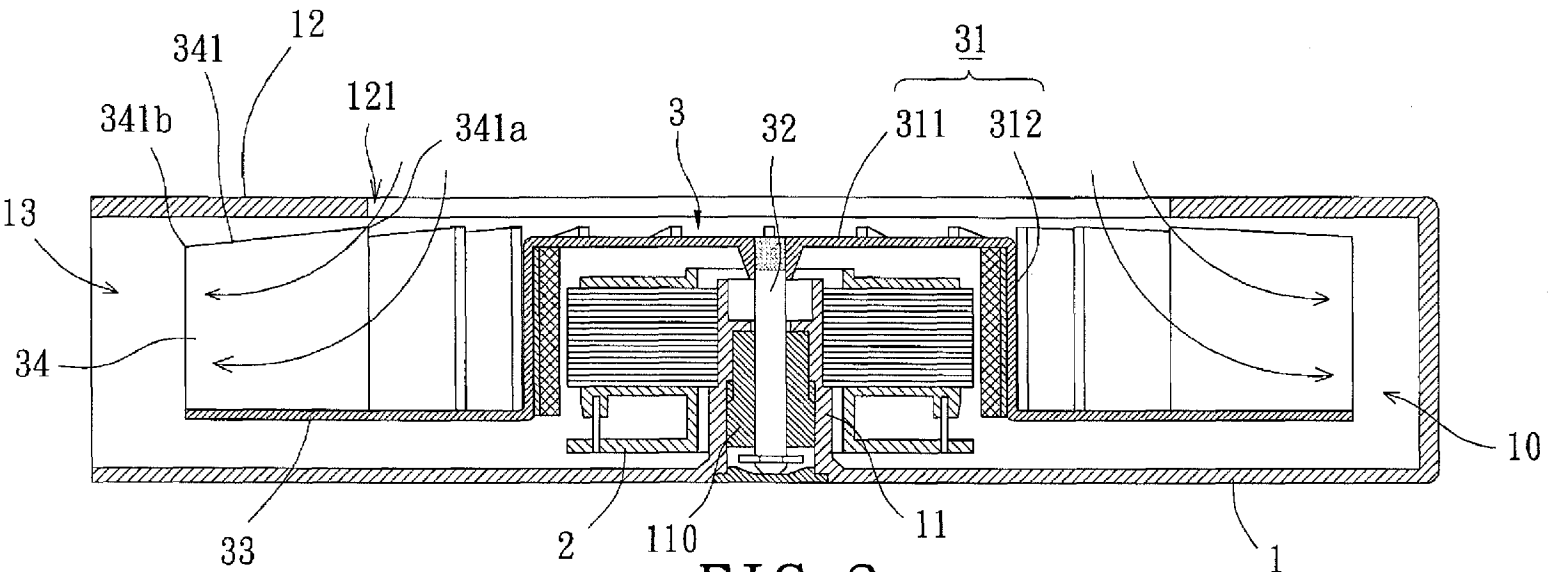
FIG. 2 is a cross sectional view of a first embodiment of a blower fan in accordance with the present invention, illustrating the routes of the air currents.
Figure 3:
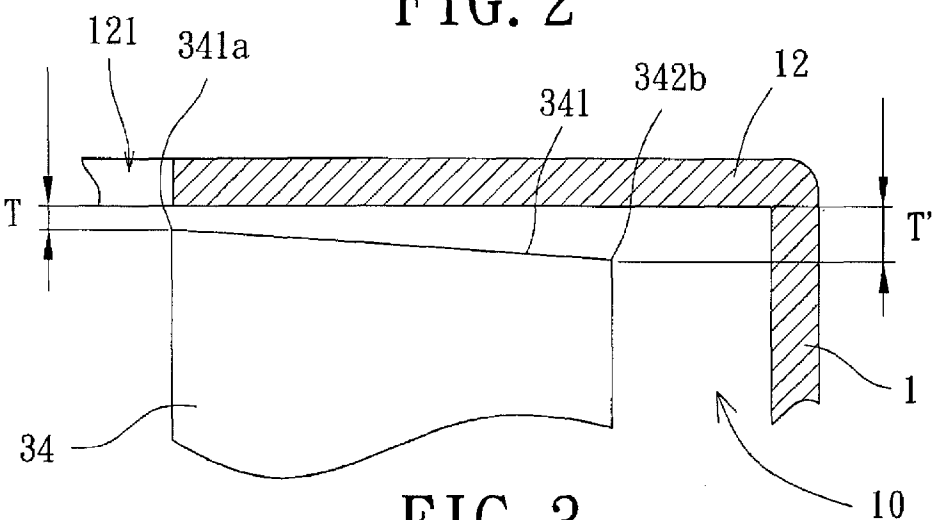
FIG. 3 is a partial, cross sectional view of the blower fan in FIG. 2, illustrating the vanes and the top of the housing.

Referring to FIGS. 2 and 3, the blower fan in accordance with the present invention is characterized as the following. Each of the vanes 34 includes an upper edge 341, whose two ends of the upper edge 341 are an air input portion 341*a* and an air output portion 341*b*, with an air gap being formed between the upper edge 341 and the cover plate 12 and with various widths of the air gap ranging from 0.3 mm to 2.0 mm while a shortest width of the air gap is formed between the air input portion 341*a* of the upper edge 341 and the cover plate 12 of the housing 1. The air input portion 341*a* is the end of the upper edge 341 adjacent to the first air inlet 121, and the air output portion 341*b* is the other end of the upper edge 341, with a first width T of the air gap between the air input portion 341*a* and the cover plate 12 being not greater than a second width T' of the air gap between the air output portion 341*b* and the cover plate 12.

While the blower fan in accordance with the present invention works, air is drawn into the compartment 10 of the housing 1 through the first air inlet 121 to form air currents with routes indicated by arrows shown in FIG. 2. Then, the air is propelled toward the air outlet 13 of the housing 1 by the vanes 34. Because a flow path, that is, the air gap formed between the upper edges 341 of the vanes 34 and the cover plate 12 gradually narrows in a direction from the air output portion 341*b* to the air input portion 341*a*, the air is not liable to flow reversely to the first air inlet 121. Thereby, turbulence formed at the first air inlet 121 adjacent to the air input portion 341*a* is avoided and the wind shear noises are reduced.

Figure 4:
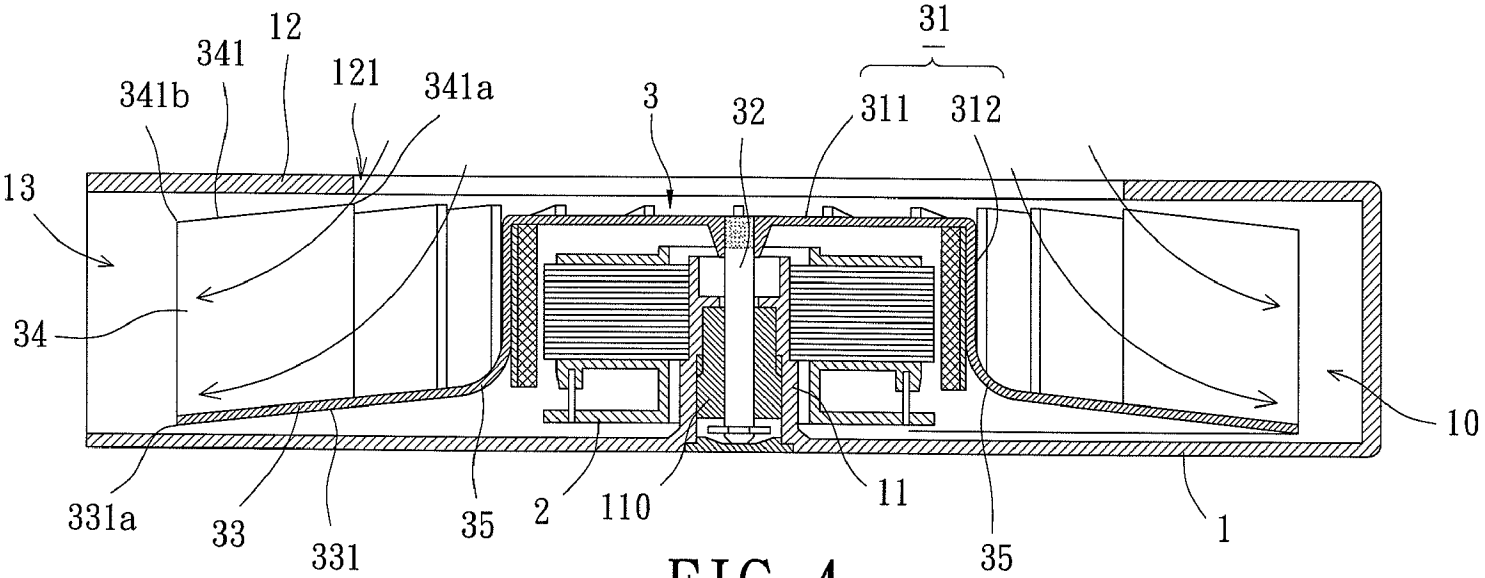
FIG. 4 is a cross sectional view of a second embodiment of a blower fan in accordance with the present invention, illustrating the routes of the air currents.
Figure 5:
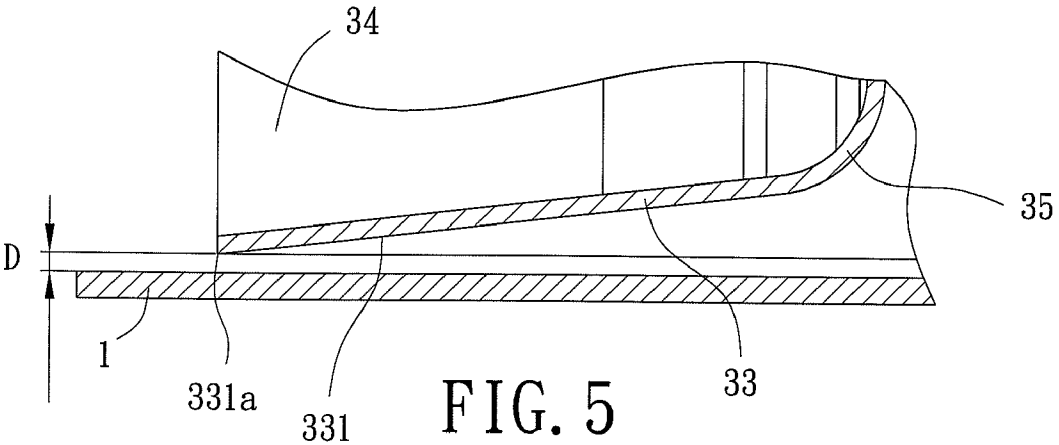
FIG. 5 is a partial, cross sectional view of the blower fan in FIG. 4, illustrating the enclosing plate and the bottom of the housing.

In the second embodiment shown in FIGS. 4 and 5, the enclosing plate 33 is not perpendicular to the side wall 312 but inclined relative to the side wall 312 to form an obtuse angle between the enclosing plate 33 and the side wall 312. The enclosing plate 33 includes a lower surface 331 back to the vanes 34, whose end is a lateral edge 331*a* distant from the hub 31, of the enclosing plate 33, with another air gap being formed between the lower surface 331 and the bottom of the housing 1 and with various widths of the air gap ranging from 0.3 to 2.0 mm, while a shortest width is formed between the lateral edge 331*a* of the lower surface 331 and the bottom of the housing 1. A width D of the air gap between the lateral edge 331*a* of the lower surface 331 and the bottom of the housing 1 is the shortest one among the widths of the air gap between the lower surface 331 and the housing 1. Moreover, a curved surface 35 is formed at a portion where the enclosing plate 33 and the side wall 312 connects and located in a lower area of the air-flowing interval.

Further referring to FIG. 5, in the second embodiment of the blower fan in accordance with the present invention, with the various widths of the air gap between the lower surface 331 and the bottom of the housing 1 limited in the range from 0.3 to 2.0 mm, widths between the lower surface 331 and the cover plate 12 are larger in comparison with that of the first embodiment of the blower fan. A flow path formed between the cover plate 12 and the enclosing plate 33 gradually broadens in a direction from the curved surface 35 to the lateral edge 331*a*. Accordingly, when the air is drawn into the air-flowing interval through the first air inlet 121 to form air currents with routes indicated by arrows shown in FIG. 4, the curved surface 35 guides the air to flow to the vanes 34, for avoiding turbulence formed between the side wall 312 and the enclosing plate 33. Besides, based on the gradually broadening flow path, the air flows smoothly after entering the compartment 10, so as to elevate the amount of output air, avoid turbulence formed between the enclosing plate 33 and the bottom of the housing 1, and reduce the wind shear noises.

Figure 6:
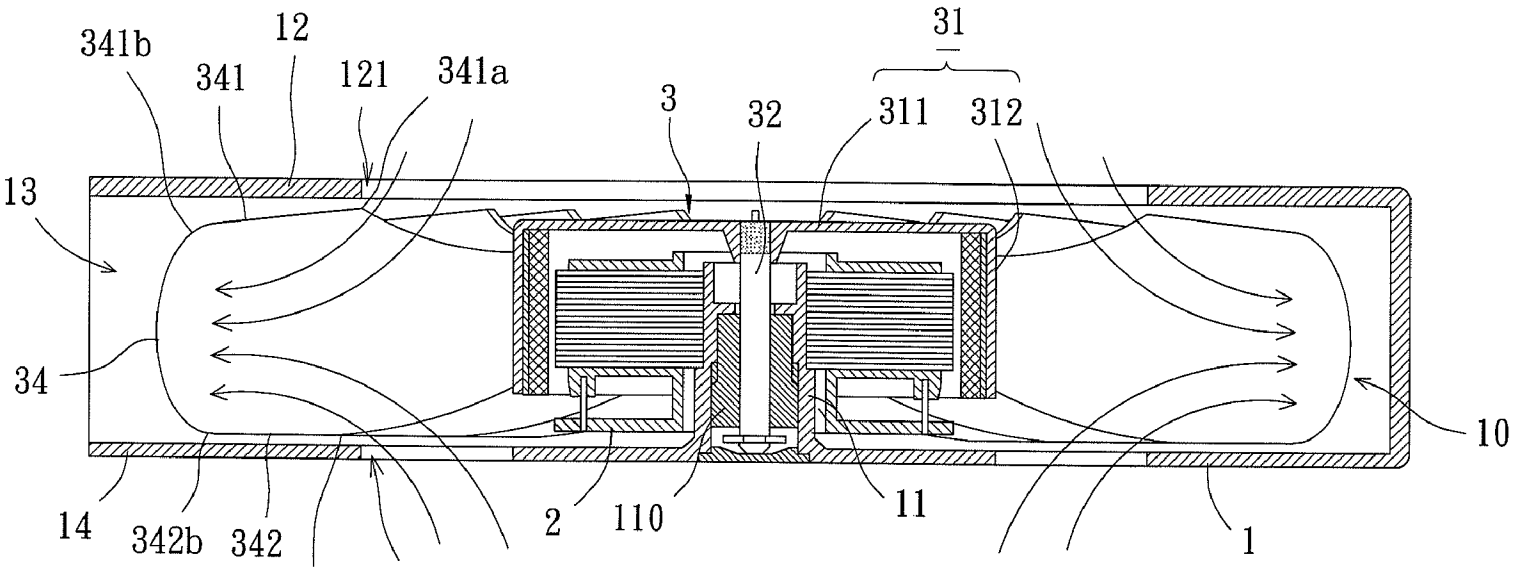
FIG. 6 is a cross sectional view of a third embodiment of a blower fan in accordance with the present invention, illustrating the routes of the air currents.

In a third embodiment shown in FIG. 6, the housing 1 further includes a base plate 14 formed on the bottom of the housing 1. Particularly, the housing 1 has not only the first air inlet 121 on the cover plate 12, but a second air inlet 141 on the base plate 14. The first air inlet 121 and the second air inlet 141 is formed on the top and the bottom of the housing 1 respectively and communicating with the compartment 10.

Figure 7:
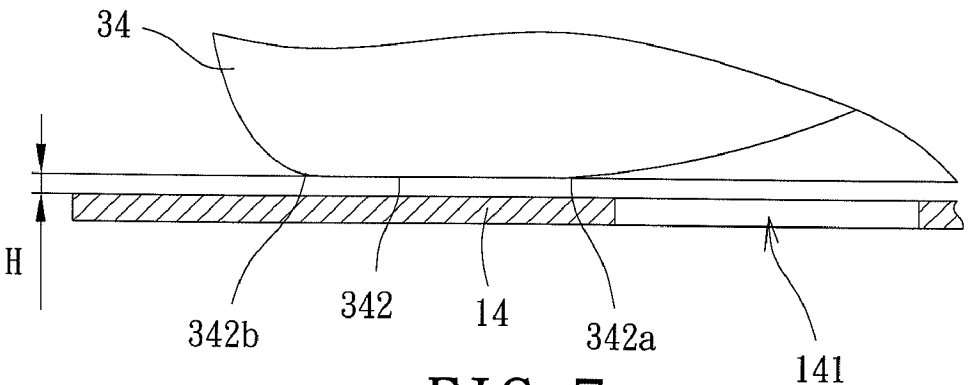
FIG. 7 is a partial, cross sectional view of the blower fan in FIG. 6, illustrating the lower edges of the vanes and the base plate.

Referring to FIG. 7, each vane 34 with the upper edge 341 and a lower edge 342 is coupled to the side wall 312 of the hub 31 on an end thereof. Each upper edge 341 still has the air input portion 341*a* and air output portion 341*b* similar to that of the first embodiment of the blower fan in accordance with the present invention. Two ends of the lower edge 342 are an air input portion 342*a* and an air output portion 342*b*, and an air gap being formed between the lower edge 342 and the base plate 14 with various widths of the air gap ranging from 0.3 mm to 2.0 mm, while a shortest width is formed between the air input portion 342*a* of the lower edge 342 and the base plate 14 of the housing 1. The end of the lower edge 342 adjacent to the second air inlet 141 is the air input portion 342*a*, and the other end of the lower edge 342 is the air output portion 342*b*, with the width H formed between the air input portion 342*a* and the base plate 14 being not greater than the width between the air output portion 342*b* and the base plate 14. In the third embodiment, a section of the lower edge 342 between the air input portion 342*a* and air output portion 342*b* is parallel to the base plate 14; that is, the width H between the air input portion 342*a* and the base plate 14 is equal to the width between the air output portion 342*b* and the base plate 14.

While the blower fan in accordance with the present invention works, air is drawn into the compartment 10 of the housing 1 through the first and second air inlet 121, 141 to form air currents with routes indicated by arrows shown in FIG. 6. By reducing the width of the air gap between the upper edges 341 and the cover plate 12, and reducing the width of the air gap between the lower edges 342 and the base plate 14, air is not liable to flow reversely to the first air and second inlet 121, 141 so as to avoid the turbulence formed at the first and second air inlet 121, 141 adjacent to the air input portion 341*a*, 342*a* and reduce the wind shear noises.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A blower fan comprising:

a housing having an air outlet and a cover plate providing a first air inlet and formed on a top of the housing, with the first air inlet and the air outlet being communicated with a compartment of the housing;

a stator being mounted in the compartment; and an impeller being mounted in the compartment, with the impeller having a hub and a plurality of vanes coupled to the hub, and with each vane having an upper edge, wherein, for each vane, an end of the upper edge is an air input portion adjacent to the first air inlet of the cover plate, and an air gap is formed between the upper edges of the vanes and the top of the housing, with various widths of the air gap ranging from 0.3 mm to 2.0 mm while a shortest width of the air gap is formed between the air input portion of the upper edge and the cover plate of the housing.

2. The blower fan as claimed in claim 1, with the other end of the upper edge of each vane being an air output portion, and with the width between the air input portion and the cover plate being not greater than the width between the air output portion and the cover plate.

3. The blower fan as claimed in claim 1, with the housing further including a base plate formed on a bottom of the housing, and with the base plate having a second air inlet communicating with the compartment.

4. The blower fan as claimed in claim 3, with each vane including a lower edge whose end is another air input portion adjacent to the second air inlet, with an air gap being formed between the lower edge and the base plate, and with various widths of the air gap ranging from 0.3 mm to 2.0 mm while a shortest width is formed between the air input portion of the lower edge and the base plate of the housing.

5. The blower fan as claimed in claim 4, with the other end of the lower edge of each vane being an air output portion, and with the width between the air input portion and the base plate being not greater than the width between the air output portion and the base plate.

6. The blower fan as claimed in claim 1, with the hub including an upper cover and a side wall connected with an outer periphery of the upper cover, with an inner space being surrounded by the upper cover and the side wall, and with the impeller further including an enclosing plate connected with a free end of the side wall and radially extending outwards.

7. The blower fan as claimed in claim 6, with the enclosing plate including a lower surface whose end is a lateral edge distant from the hub, with an air gap being formed between the lower surface and the bottom of the housing, and with various widths of the air gap ranging from 0.3 mm to 2.0 mm while a shortest width is formed between the lateral edge of the lower surface and the bottom of the housing.

8. The blower fan as claimed in claim 7, with the enclosing plate being inclined relative to the side wall to form an obtuse angle between the enclosing plate and the side wall.

9. The blower fan as claimed in claim 6, with the enclosing plate being inclined relative to the side wall to form an obtuse angle between the enclosing plate and the side wall.

10. The blower fan as claimed in claim 9, with a curved surface being formed at a portion where the enclosing plate and the side wall connects.

11. The blower fan as claimed in claim 6, with a curved surface being formed at a portion where the enclosing plate and the side wall connects.

* * * * *